United States Patent [19]

Danel

[11] Patent Number: 4,861,342

[45] Date of Patent: Aug. 29, 1989

[54] DYEING OR FINISHING PROCESS USING PADDING WITH CONTINUOUS FIXING OF TEXTILE MATERIALS: GRAFT POLYMER AND MICROWAVE HEATING

[75] Inventor: Paul Danel, Sèvres, France

[73] Assignee: Ciba-Geigy Corporation, Ardsley, N.Y.

[21] Appl. No.: 202,752

[22] Filed: Jun. 3, 1988

[30] Foreign Application Priority Data

Jun. 5, 1987 [CH] Switzerland ..... 2146/87

[51] Int. Cl.[4] ..... D06L 3/02; D06P 1/61; D06P 5/20

[52] U.S. Cl. ..... 8/444; 8/103; 8/107; 8/532; 8/554; 8/555; 8/654; 8/680; 8/917; 8/922; 8/924; 8/927

[58] Field of Search ..... 8/555, 444, 103

[56] References Cited

U.S. PATENT DOCUMENTS 4,494,956 1/1985 Schafer et al. ..... 8/543
4,602,055 7/1986 Schafer et al. ..... 524/157
4,613,335 9/1986 Berendt et al. ..... 8/477

FOREIGN PATENT DOCUMENTS 1363277 8/1974 United Kingdom .

*Primary Examiner*—A. Lionel Clingman
*Attorney, Agent, or Firm*—Edward McC. Roberts

[57] ABSTRACT

Dyeing or finishing process characterized in that textile materials are impregnated in a padding machine with aqueous dyeing or finishing baths which contain, besides graft polymers, which may be obtained from a product of addition of an alkylene oxide to an at least trivalent aliphatic alcohol containing from 3 to 10 carbon atoms and methacrylamide or acrylamide, and in that the fixing of the dyes or of the finish is then performed continuously by a treatment with microwaves for 5 to 30 seconds.

The process permits an excess water input on all the textile materials and a rapid fixing by the microwaves.

16 Claims, No Drawings

DYEING OR FINISHING PROCESS USING PADDING WITH CONTINUOUS FIXING OF TEXTILE MATERIALS: GRAFT POLYMER AND MICROWAVE HEATING

The present invention relates to a process of dyeing or finishing using padding of textile materials, capable of being treated with products which are fixed continuously by means of microwaves.

The process is characterized in that the textile materials are impregnated in a padding machine with aqueous dye or finish baths which additionally contain grafted polymers which may be obtained by a product of addition of an alkylene oxide to an at least trivalent aliphatic alcohol containing from 3 to 10 carbon atoms and methacrylamide or acrylamide, and that the fixing of the dyes or of the finish is then continuously carried out by a treatment with microwaves for 5 to 30 seconds.

The preferred graft polymers are those which can be obtained by graft polymerization of methacrylamide, or particularly of acrylamide, onto a product of addition of 4 to 100 moles, preferably 40 to 80 moles, of propylene oxide to alcohols containing from 3 to 6 carbon atoms and exhibiting 3 to 6 valencies. These alcohols may be of the straight or branched chain type. Glycerol, trimethylolethane, trimethylolpropane, erythritol, pentaerythritol, mannitol or sorbitol may be mentioned as examples.

Other suitable graft polymers are those which may be obtained by grafting methacrylamide or acrylamide onto the products of addition of mixtures of ethylene oxide and propylene oxide, or else of ethylene oxide alone, to the polyvalent alcohols mentioned.

Above all, graft polymers based on acrylamide and on products of addition of 40 to 80 moles of propylene oxide to 1 mole of glycerine have been found particularly suitable.

It is advantageous that the graft polymers employed according to the invention should contain 2.5 to 50% by weight of the addition product defined as a base chain and 50 to 97.5% by weight of grafted acrylamide or methacrylamide as side chains.

The graft polymers preferably contain 2.5 to 30% by weight of the alkylene oxide adduct according to the definition and 70 to 97.5% by weight of methacrylamide or, in particular, acrylamide. It is still more preferable that the proportion of amide in the graft polymer should have a value of 80 to 97.5% by weight.

Among these products, particular preference is given to those containing, as a base chain, 4 to 20% by weight of the product of addition of 40 to 80 moles of propylene oxide to 1 mole of glycerine and 80 to 96% by weight of acrylamide.

The percentages indicated are understood to be based on the total graft polymer.

The preparation of the graft polymer employed according to the invention is carried out according to methods which are known per se, and in a suitable manner, as follows: the polmyerization of (1) a product of addition of an alkylene oxide to an at least trivalent aliphatic alcohol containing from 3 to 10 carbon atoms, with (2) acrylamide or methacrylamide is carried out in the presence of catalysts, and appropriately at a temperature of 40° to 100° C. This produces predominantly graft polymers in which the alkylene oxide adduct forms the base chains and which contains acrylamide or methacrylamide in the form of said chains, grafted onto individual carbon atoms.

Organic, or preferably inorganic, initiators which form free radicals are appropriately used as catalysts. Organic initiators which are suitable for carrying out radical polymerization are, for example, symmetrical peroxydicarbonates, butyl peroctoate, butyl perbenzoate, peracetates or peroxydicarbamates. Suitable inorganic initiators are hydrogen peroxide, perborates, persulfates or peroxydisulfates.

The preferred initiator or activator is potassium peroxydisulfate.

These catalysts may be introduced in a proportion of 0.05 to 5% by weight, advantageously from 0.05 to 2% by weight, and preferably from 0.1 to 1% by weight, relative to the starting material.

The graft polymerization is advantageously carried out under an inert atmosphere, for example in the presence of nitrogen.

The products of graft polymerization appear in the form of a highly viscous mass. Gelatinous products with a solids content of, for example, 0.5 to 20% by weight, preferably 2 to 20% by weight, can be prepared by dissolving and diluting with water. For storage and/or to improve the storage stability of the aqueous solutions of graft polymers which are obtained, preserving agents may be added, such as, for example, chloroacetamide, N-hydroxymethylchloroacetamide, alkali metal pentachlorophenolates and nitrites, triethanolamine, or else, preferably, hydroquinone monomethyl ether, or, yet again, an antibacterial agent such as, for example, sodium azide or else surface-active quaternary ammonium compounds which contain one or two alkylaliphatic residues. More advantageously, mixtures of these preserving agents and germicidal compounds may also be introduced.

The particularly preferred graft polymer solutions obtained, which have a concentration of 2 or 3 up to 5%, have a viscosity of 3,000 up to 150,000, preferably from 20,000 up to 120,000, and especially from 40,000 up to 80,000 mPa s (millipascal seconds) at 25° C. The polyalkylene oxide adducts employed for the preparation of the graft polymers have, as a general rule, a molecular weight of between 400 and 6,000, and preferably between 3,000 and 4,500.

The quantities of graft polymers which are introduced into the dye baths may vary within wide limits. Thus, quantities ranging from 3 to 50 g, preferably from 5 to 40 g and in particular from 8 to 20 g have been found advantageous, in the form of aqueous solutions at a concentration ranging from 3 to 10%, per liter of dye bath.

The process according to the present invention is suitable for the application both of chemical substances and also of dyes to textile substrates such as, for example, worsteds, yarns, self-coloured fabrics, terry towelling, velvets, carpets, knits or sheets. These substrates include all the usual natural and synthetic fibrous materials such as cotton, hemp, linen, China grass, regenerated cellulose, cellulose acetate (2½- or triacetate), polyester, polyacrylonitrile, polyamide, wool, silk, polypropylene, or mixtures of various fibres such as the mixed polyester-cellulose or polyester-wool fabrics.

For dyeing according to the present invention, all the usual classes of dyes are considered, for example dispersion dyes, substantive dyes, reactive dyes, acid dyes and basic dyes, as well as suitable mixtures of such dyes which are conventional in practice. Examples of dyes are described in the Colour Index, 3rd edition, 1971, volume 4.

Chemical substances which may be applied according to the present invention are considered to be all the chemical substances which are suitable for their introduction into the textile industry, such as finishing and protective agents, binding agents, purifying agents and finishes, as well as optical whiteners. The application of antistatic, water-repellent, fireproofing, crease-resistance, easy-care, starching, dirt-repellent or soil-removal agents is considered, for example.

The process according to the invention is preferably suitable for dyeing textiles consisting of cellulose or containing it, the textile materials being subjected, after the padding stage, to a process of microwave treatment, in order to fix the dye applied.

The fixing of the dye takes a short time and is carried out continuously using microwaves. After impregnation with the dye bath and being wrung out in a padding mangle, the material is subjected to an irradiation in a microwave field to heat the fabric and to keep it at the temperature needed to fix the dyes or other chemical substances on the textile fibres.

This microwave treatment is carried out in an equipment consisting of a magnetron microwave generator of a known type, equipped with a multiple serpentine waveguide ending in a water charge. This waveguide may be of what is known as a "split" type, with the fabric to be treated running at a constant speed through slots arranged lengthwise in the side walls of the waveguide. Preferably, a waveguide of what is known as a "source-slots" type is employed, provided with a system of multiple slots in the upper wall of the waveguide, which are either oblique or parallel to the guide and offset relative to its axis, with the fabric running in the stretched state at a fixed distance from the waveguide, depending on the wavelength of the microwave generator, and at a constant speed. A protective device (circulator) is inserted between the output of the generator and the waveguide to prevent reflected waves from damaging the magnetron. The whole is surrounded by a Faraday cage in order to protect the operators against the microwave radiation.

The microwave treatment can take from 5 to 30 seconds. 5 to 18 seconds are preferably sufficient. "Microwaves" is used to denote electromagnetic waves (radio waves) in the frequency range from 300 to 30,000 MHz (megahertz) and preferably from 800 to 4,000 MHz, and whose power may vary between 0.8 and 25 kW (kilowatts), preferably between 800 and 3,500 watts.

The cellulosic material is envisaged to be such materials consisting of regenerated cellulose or, in particular, of natural cellulose, such as, for example, staple rayon, viscose-silk, hemp, linen, jute, or preferably cotton, as well as mixtures of fibres, for example those consisting of polyamides and cotton or, in particular, of polyester and cotton.

The cellulosic material may then be at treatment stages which are of a very wide variety, particularly, however, in the woven or knitted state such as, for example, a tubular knit. A raw product and a pretreated product may be employed equally well.

Insofar as the dyes for dyeing cellulosic materials are concerned, these are substantive dyes or else, above all, reactive dyes which are usually employed for dyeing cellulosic fabric materials.

Suitable substantive dyes are the usual direct dyes, for example those which appear in the "Colour Index", 3rd edition (1972) volume 2, pages 2005–2478, under the heading of "Direct Dyes".

"Reactive dyes" means the usual dyes which form a chemical bond with cellulose, for example those which appear in the "Colour Index", in volume 3 (3rd edition, 1971), pages 3391–3560, and in volume 6 (revised 3rd edition, 1975), pages 6268–6345, under the heading "Reactive Dyes".

The quantity of dyes is generally determined according to the desired intensity and is suitably at a value of between 0.1 and 100 g per liter of bath, preferably between 5 and 60 g/l of bath.

Alkaline reactive compounds which are introduced to fix the dye are, for example, sodium carbonate, sodium bicarbonate, sodium hydroxide, disodium phosphate, trisodium phosphate, borax, aqueous ammonia, or else a product which generates an alkali, such as sodium trichloroacetate. In particular, a mixture consisting of an aqueous solution of sodium silicate and of an aqueous solution of 30% strength sodium hydroxide has been found highly satisfactory as an alkali. The pH value of the dye bath containing the alkali is generally from 7.5 to 13.2, preferably from 10.5 to 12.5.

The textile materials may also be natural or synthetic polyamides such as wool, silk, nylon 6 and 66 and mixtures thereof, including modified-affinity polyamides.

These polyamide materials are capable of being dyed with anionic dyes. The compounds involved for these dyes are, for example, salts of monoazo, diazo or polyazo dyes, including the formazan dyes, containing heavy metals or, preferably, metal-free, as well as anthraquinone, xanthene, nitro, triphenylmethane, naphthoquinoneimine and phthalocyanine dyes. The anionic nature of these dyes may be due solely to the formation of metal complexes and/or preferably to the presence of acidic substitutents which form salts, such as carboxylic groups, sulfuric ester groups and phosphonic ester groups, and phosphonic acid groups or sulfonic acid groups. These dyes may also contain in their molecule what is known as reactive groups, which form a covalent bond with the material to be dyed. Those referred to as metal-free acidic dyes are preferred. The latter preferably contain only a single sulfonic group and, optionally, another group which is hydrosolubilizing but which does not form salts, such as the amide or alkylsulfonyl groups.

The 1:1, or preferably 1:2, metal complex dyes are also particularly advantageous. The 1:1 metal complex dyes preferably contain one or two sulphonic acid groups. As a metal, they contain an atom of a heavy metal such as, for example, copper, nickel or, in particular, chromium.

The 1:2 metal complex dyes contain, as a central atom, an atom of a heavy metal such as, for example, an atom of cobalt or, in particular, an atom of chromium. Two complexing components are bonded to the central atom, at least one of these being a dye molecule, but, preferably, both are dye molecules. In this case, both molecules of dye which take part in forming a complex may be identical or different from one another. The 1:2 metal complex dyes may, for example, contain two molecules of azomethine, a molecule of diazo dye and a molecule of monoazo dye or, preferably, two molecules of monoazo dye. The molecules of azo dyes may contain hydrosolubilizing groups such as, for example, amide groups, alkylsulfonyl groups, or the acidic groups referred to above. The 1:2 cobalt or chromium complexes of monoazo dyes which contain amide or alkylsulfonyl groups, or else a single sulfonic acid group in all, are preferred.

It is also possible to employ mixtures of anionic dyes. Mixtures of at least two or three anionic dyes are particularly advantageous for preparing plain dichromatic or trichromatic dyes.

The quantity of anionic dyes which is added to the bath is determined by the desired intensity of the colours. In general, quantities of between 0.01 and 25, in particular between 0.1 and 15, g/liter of bath are recommended.

The dye baths may contain inorganic acids, such as sulfuric acid or phosphonic acid, organic acids, advantageously lower aliphatic carboxylic acids such as, for example, formic acid, acetic acid or oxalic acid, and/or salts such as, for example, ammonium acetate, ammonium sulfate, sodium hydrogen phosphate, potassium hydrogen phosphate, potassium acetate or sodium acetate. The acids are used, above all, for adjusting the pH of the baths employed in accordance with the invention, which pH is generally situated between 4 and 7.5, preferably between 4.5 and 6.5.

In addition, the dye baths may also contain the usual electrolytes, dispersants, foam suppressors and wetting agents.

The subject of the present invention is also a process for dyeing synthetic textile materials with cationic or dipserse dyes. The synthetic textile materials which may be dyed according to the invention are, for example, cellulose ester fibres, such as cellulose 2½-acetate or triacetate fibres, synthetic polyamide fibres, e.g. those based on ε-caprolactam, adipic acid and hexamethylenediamine and on ω-aminoundecanoic acid, aromatic polyamide fibres derived from poly(metaphenyleneisophthalamide), polyacrylonitrile fibres including the "Modacryl" fibres modified acidic polyester fibres and, in particular, linear polyester fibres. Among these, cellulose ester, polyamide and polyester fibres are preferably dyed with disperse dyes, and polyacrylonitrile fibres, modified acidic polyester fibres and aromatic polyamide fibres are preferably dyed with cationic dyes.

The term "linear polyester fibres" is to be understood to mean synthetic fibres which are obtained by condensing terephthalic acid with ethylene glycol or butylene glycol or isophthalic or terephthalic acid with 1,4-bis(-hydroxmethyl)cyclohexane, and copolymers of terephthalic and isophthalic acids with ethylene glycol. The linear polyester employed almost exclusively until now in the textile industry is made up of terephthalic acid and ethylene glycol. The commercial types of acrylonitrile polymers and copolymers form part of acrylic fibres which may be dyed using the process according to the invention. In the case of acrylonitrile copolymers, the suitable content of acrylonitrile is at least 80 percent by weight, relative to the weight of the copolymer. The modified acidic polyester fibres are, for example, products of polycondensation of terephthalic acid or of isophthalic acid, ethylene glycol and 1,2- or 1,3-dihydroxy-3-(3-sodiumsulfopropoxy)propane, 2,3-dimethylol-1-(sodiumsulfopropoxy)butane, 2,2-bis(3-sodiumsulfopropoxyphenyl)propane or 3,5-dicarboxybenzenesulfonic acid or sulfonated terephthalic acid, sulfonated 4-methoxybenzenecarboxylic acid or sulfonated 4,4'-diphenyldicarboxylic acid.

The fibre materials may be mixed together during weaving, or with other fibres, and may be employed as such, e.g. as polyacrylonitrile/polyester, polyamide/-polyester, polyester/cotton, polyester/viscose and polyester/wool mixtures.

The cationic dyes which are suitable for the process according to the invention may belong to different types of dyes. In particular, they may involve the usual salts, for example metal chlorides, sulfates or halides such as, e.g. zinc chloride double salts of cationic dyes whose cationic nature is contributed, e.g. by a carbonium, oxonium, sulfonium or, above all, ammonium group. Examples of such chromophoric systems are azo dyes, especially monoazo or hydrazone dyes, diphenylmethane, triphenylmethane, methine or azomethine dyes, and coumarin, ketoneimine, cyanine, azine, xanthene, oxazine or thiazine dyes. Lastly, it is also possible to use coloured salts of the phthalocyanine or anthraquinone series containing an external onium group, for example an alkylammonium or cycloammonium group, as well as coloured 1,2-benzopyran salts containing cycloammonium groups.

The disperse dyes to be employed, which are very poorly soluble in water and which, for the most part, are present in the bath in the form of a fine dispersion, may belong to the widest variety of dye types, for example acridone, azo, anthraquinone, coumarin, methine, perinone, naphthoquinoneimine, quinophthalone, styryl or nitro dyes.

Mixtures of cationic or disperse dyes may be employed according to the invention.

The cationic and disperse dyes are preferably employed in a quantity of 0.5 g to 50 g per liter of bath.

The dyeing process according to the invention may also be employed for whitening undyed textile materials with optical whiteners which are suitable for all the substrates indicated above. In this case, polyester or cellulosic fibre materials are preferably treated with water-soluble or dispersed optical whiteners, depending on the nature of the substrate to be treated. The whitening may be combined with a bleaching process.

The optical whiteners may be anionic or cationic or water-dispersible and may belong to any type of whiteners. They include, in particular, coumarin, triazolcoumarin, benzocoumarin, oxazine, pyrazine, pyrazoline, diphenylpyrazoline, stilbene, styrylstilbene, triazolylstilbene, bisbenzoxazolylethylene, stilbenebisbenzoxazoles, phenylstilbenebenzoxazoles, thiophenebisbenzoxazoles, naphthalenebisbenzoxazoles, benzofuran, benzimidazoles and naphthalimides.

Mixtures of optical whiteners may also be employed according to the invention.

Besides the graft polymerization products it has frequently been found advantageous to add to the dyeing or finishing bath commercial wetting agents which are stable towards alkalis, for example ester sulfonates of a polycarboxylic acid such as dihexyl sulfosuccinate or dioctyl sulfosuccinate, alkylarylsulfonates containing a straight or branched alkyl chain including at least 6 carbon atoms such as, for example, dodecylbenzenesulfonates or, preferably, alkylsulfonates in which the alkyl chain contains from 8 to 20 carbon atoms, such as, for example, dodecylsulfonates or pentadecylsulfonates. As a general rule, the sulfonates mentioned as wetting agents are present in the form of alkali metal salts particularly, however, in the form of sodium salts or else ammonium salts.

The quantities of wetting agents which are added to the padding bath vary optimally between 1 and 10 g, preferably between 1.5 and 5 g per liter of bath.

The padding baths are best prepared beforehand by dissolving or dispersing the dye and by adding the graft polymerization product. Depending on the dye employed, the dyeing baths may contain other usual additives, for example electrolytes such as, for example, sodium chloride or sodium sulfate, alkali or acid, as well as urea, oxidizng agents, glycerine, levelling agents, crosslinking agents and usual foam suppressants and/or sodium formate. They may also optionally contain a thickening agent such as, for example, alginates, starch, ether, polyacrylic acid or else carob flour ether.

An increase in the absorption of the dye bath which may go up to 40% is attained with the process according to the invention, and this is followed by a fast fixing by the microwaves and also by an increase in the tinting efficiencies. Even when small quantities of the graft polymerization product according to the definition are added, an increase is obtained in the degree of bath extraction, followed by significantly improved tinting efficiencies.

Furthermore, samples of uniform and intense tints are obtained, which are characterized by a uniform appearance of the fabric. In addition, the dye fastness properties such as, for example, light fastness, rubbing fastness and moisture fastness are not affected in a negative way by the introduction of the specified graft polymerization product.

Another subject of the present invention is a bleaching process, preferably for cotton, with an aqueous padding bath containing the graft polymerization product, a peroxide, an alkali metal hydroxide, a surfactant and at least one stabilizer, characterized in that the cotton is impregnated with the bleaching bath and that the impregnated cotton is subjected to the treatment by means of microwaves.

The bleaching baths employed both in conventional bleaching processes and in the bleaching process according to the present invention are known per se and are described e.g. in European Pat. No. 0,082,823 and in Swiss patent applications Nos. 3141/85-7 and 3142/85-9. They generally contain (A) an organic oxidizing agent such as, e.g. a peroxide, persalts such as sodium persulfate, but preferably hydrogen peroxide, especially in the commercial form of concentrated aqueous solutions, (B) the alkali metal hydroxide, preferably potassium or sodium hydroxide, (C) one or more, generally nonionic, surfactants, optionally mixed with one or more anionic surfactants such as the products of addition of fatty alcohols and/or alkylphenols to an alkylene oxide, and (D) at least one peroxide stabilizer chosen from the group of optionally oligomeric esters of hydroxyethane-1,1-diphosphonic acid, of aminopoly(alkylenephosphonic) acids, of alkanepolyphosphonic acids or of polyaminocarboxylic acids such as, e.g. diethylenetriaminepentaacetic acid and its salts, particularly its magnesium salts, polyhydroxylated compounds such as gluconic acid and its alkali metal salts of its $\gamma$-lactone and of an alkali metal silicate such as sodium silicate.

In addition, the bleaching baths may advantageously contain, as optional components, a hydrotropic agent, e.g. urea, a magnesium salt, e.g. $MgCl_2$ optionally in hexahydrate form, an inhibitor of the precipitation of alkaline-earth salt, e.g. an optionally partially hydrolyzed polymaleic acid, an antifoam or a deaerating agent such as higher alcohols, particularly isopropanol, n-octanol, an ethylhexanol or trimethylhexanol and/or commercial silicone oils.

The quantities of the bleaching agent preparations which may be added to the padding bath vary optimally between 2 and 30 g per liter of bath, preferably between 5 and 20 g/l.

In the methods of preparation and the examples which follow, the percentages are given by weight, when there is no other indication. In the case of the dyes, the quantities refer to commercial, that is to say cut, products, and in the case of the adjuvants to the pure substances. The five-digit Colour Index (C.I.) numbers are taken from the 3rd edition of the Colour Index.

METHODS OF PREPARATION

Operating method 1: A solution of 22.5 g of acrylamide, 2.5 g of a product of addition of 52 moles of propylene oxide to 1 mole of glycerine, and 0.04 g of potassium peroxydisulfate, in 200 g of water, is heated to 50° C., with stirring and with nitrogen purging, and is kept at this temperature for 3 hours. A solution of 0.03 g of potassium peroxydisulfate in 40 g of water is allowed to drip into it for 60 minutes, and the highly viscous solution is diluted by adding 300 ml of water over a period of 30 minutes. The reaction mixture is then maintained at 50° C. for 5 hours and 0.6 g of hydroquinone monomethyl ether and 0.12 g of sodium azide are then added to it, and it is then cooled to ambient temperature while being stirred. 565 g of a gel whose polymer content is 4.4% are obtained. This gel has a viscosity, measured at 25° C., of 112,957 mPa s.

Operating method 2: A solution of 71.25 g of acrylamide, 3.75 g of an adduct of propylene oxide and of glycerine with an average molecular weight of 4,200 and 0.09 g of potassium peroxydisulfate in 600 g of water is prepared; this solution is heated to 50° C. with stirring and with nitrogen purging, and it is kept at 50° C. for 3 hours. The viscosity of the solution increases progressively. A solution of 0.06 g of potassium peroxydisulfate in 120 g of water is allowed to drop into it over a period of 60 minutes. Approximately 10 minutes after the start of the dropwise addition, the viscosity of the solution becomes so high that 600 g of water need to be added thereto over the following 20 minutes. After the dropwise addition of the potassium peroxydisulfate solution has been completed, the solution, whose viscosity continues to increase, is kept at 50° C. for a further 5 hours, while being diluted with 400 g of additional water, added portionwise. 1.7 g of hydroquinone monomethyl ether are added, cooling to ambient temperature is applied with stirring, and 1,794 g of a free-flowing gel are obtained, which has a polymer content of 4.3%. This gel has a viscosity, measured at 25° C., of 64,202 mPa s.

Operating method 3: A solution of 71.25 g of acrylamide, 3.75 g of an adduct of propylene oxide and of pentaerythritol which has an average molecular weight of 3,550, and 0.09 g of potassium peroxydisulfate, in 600 g of water is heated to 50° C., with stirring and with nitrogen purging, and is kept at 50° C. for 3 hours. The viscosity of the solution increases progressively. A solution of 0.06 g of potassium peroxydisulfate in 120 g of water is allowed to drip in over a period of 60 minutes. The viscosity of the solution increases for approximately 30 minutes after the end of the dropwise addition. 600 g of water are therefore added to it over the following 20 minutes. The solution, whose viscosity increases regularly, is then kept at 50° C. for a further 4 hours, and it is then diluted with 400 g of additional water, 3.4 g of triethanolamine are added to it, and it is cooled to ambient temperature while being stirred, and 1,793 g of a gel are obtained, which is still fluid and which has a solids content of 4.0%. This gel has a viscosity, measured at 25° C., of 75,300 mPa s.

Operating method 4: A solution of 17.8 g of acrylamide, 0.94 g of a product of addition of 70 moles of propylene oxide and 6 moles of ethylene oxide to 1 mole of glycerine, and 0.025 g of potassium peroxydisulfate, in 250 g of water, is heated to 50° C., with stirring and under a nitrogen purge, and is kept at this temperature for 3 hours. The temperature of the solution is raised to 60°-63° C. over a period of 20 minutes, until the viscosity increases significantly, and is then cooled to 55° C. The solution, whose viscosity continues to increase, is kept at 55° C. for 5 hours. A solution of 0.45 g of chloroacetamide and 0.45 g of hydroquinone monomethyl ether in 177 g of water is then added to the viscous solution, and 446 g of a gel are obtained, in which the content of the graft polymerization product is 4.2%. This gel has a viscosity, measured at 25° C., of 96,750 mPa s.

Operating method 5: When, in the operating method 4, the addition product indicated is replaced with another product of addition of 53 moles of propylene oxide to 1 mole of trimethylolpropane, 446 g of a gel which has a graft polymerization product content of 4.2% are thus obtained. This gel has a viscosity, measured at 25° C., of 19,500 mPa s.

Operating method 6: A solution of 17.24 g of acrylamide, 4.31 g of a product of addition of 70 moles of propylene oxide to 1 mole of glycerine, and 0.035 g of potassium peroxydisulfate, in 200 g of water, is heated to 50° C. with stirring and under nitrogen purging, and is kept at this temperature for 4 hours. The solution, whose viscosity continues to increase, is then heated to 55° C. for 5 hours. A solution of 0.4 g of chloroacetamide and 0.4 g of hydroquinone monomethyl ether in 291 g of water is added to the gel, and 513 g of a gel which has a polymer content of 4.2% are obtained. This gel has a viscosity, measured at 25° C., of 25,750 mPa s.

Operating method 7: A mixture of 15.1 g of acrylamide, 6.5 g of a product of addition of 70 moles of propylene oxide to 1 mole of glycerine, and 0.025 g of potassium peroxydisulfate, in 200 g of water, is heated to 50° C., with stirring and under a nitrogen purge, and is kept at this temperature for 3 hours. The solution, whose viscosity continues to increase is then heated to 55° C. for 5 hours. A solution of 0.4 g of chloroacetamide and 0.4 g of hydroquinone monomethyl ether in 291 g of water is then added to the gel, and 512 g of a gel which has a polymer content of 4.2% are obtained. This gel has a viscosity, measured at 25° C., of 16,300 mPa s.

Operating method 8: A mixture of 13 g of acrylamide, 8.7 g of a product of addition of 70 moles of propylene oxide to 1 mole of glycerine, and 0.015 g of potassium peroxydisulfate, in 150 g of water, is heated, with stirring and under a nitrogen purge, to 50° C., and is kept at this temperature for 4 hours. The solution, which becomes increasingly viscous, is then heated to 65° C. for 2 hours and then again to 60° C. for 3 hours. A solution of 0.4 g of chloroacetamide and 0.4 g of hydroquinone monomethyl ether in 347 g of water is added to the gel and 519 g of a gel which has a polymer content of 4.2% are obtained. This gel has a viscosity, measured at 25° C., of 15,582 mPa s.

EXAMPLES OF APPLICATION

Example 1: Cotton dyeing

A cotton corduroy fabric with a weight of 280 g/m$^2$ is impregnated in a padding machine at 25° C. with an aqueous solution containing, per liter:

8 g of the dye of formula

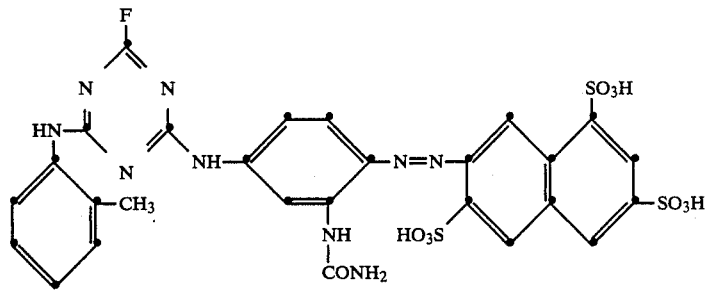

(101)

12 g of the dye of formula

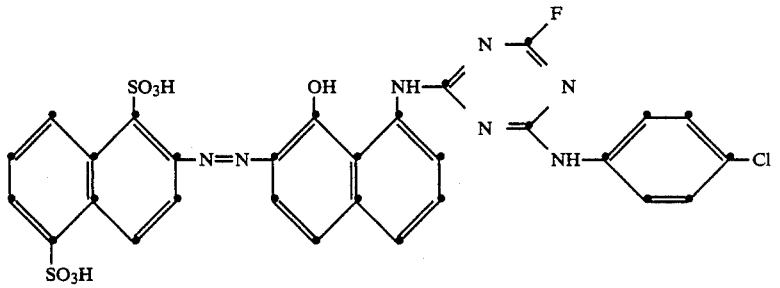

(102)

9 g of the dye of formula (103)

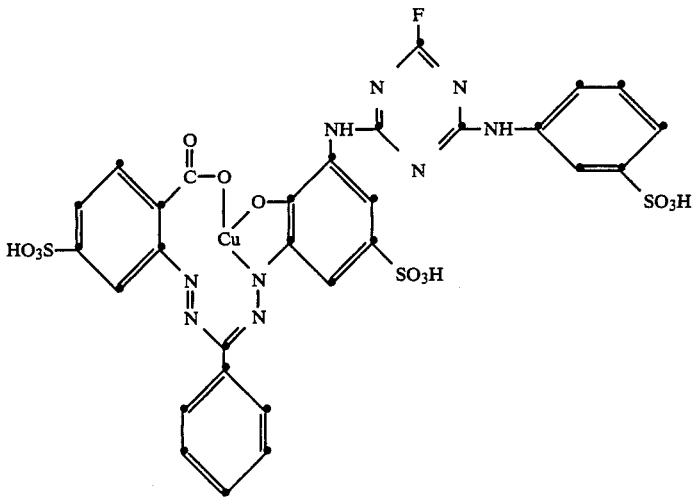

10 g of a graft polymerization product prepared according to the operating method 2,
2 g of a wetting agent,
60 g of anhydrous sodium sulfate
15 g of sodium bicarbonate, and
5 g of meta-nitrobenzensulfonic aid (sodium salt)

With an immersion time of 1.6 seconds and a roll pressure of 1.8 bars, a pick-up of 102% is obtained.

The substrate is then subjected to the action of the microwave field of a source-slots waveguide powered by a magnetron microwave generator at a frequencey of 2,450 MHz (megahertz) and a power of 2,500 watts. The fabric strip impregnated with the dye bath runs at a distance of 12.2 cm from the waveguide, the running speed being adjustd so as to give a residence time of 12 seconds in the microwave field. After washing, rinsing and drying, a wine-red toned tint is obtained, characterized by the uniform appearance of its lap.

Example 2: PES/CO dyeing

A mercerized polyester/cotton (50:50) gabardine fabric with a weight of 160 g/m$^2$ is impregnated in a padding machine at 25° C. with a bath which contains, per liter:

15 g of the dye of formula (104)

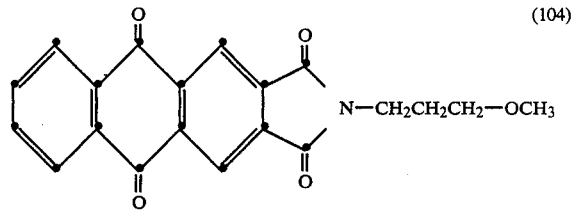

14 g of the dye of formula (105)

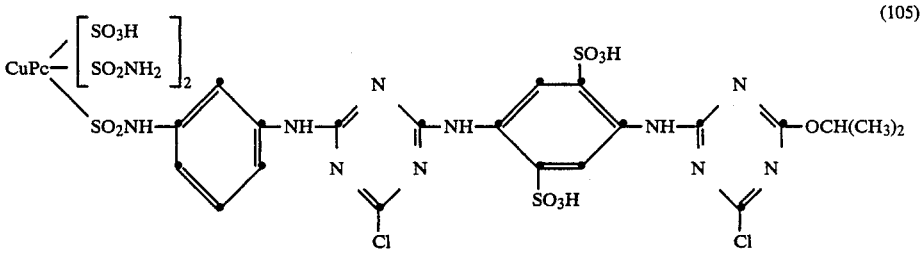

0.2 g of the dye of formula (103)
10 g of a graft polymerization product prepared according to the operating method 2
3 g of a wetting agent
10 g of a polyacrylic acid-based thickening agent
50 g of urea, and
15 g of sodium bicarbonate.

With an impregnation time of 2 seconds and a roll pressure of 1.8 bars, a pick-up of 95% is obtained.

The fabric is then continuously irradiated with microwaves at a power of 2,500 watts (2,450 MHz frequency) for 9 seconds. After this treatment, the substrate is rinsed cold and is then washed at 85° C., and then rinsed cold again.

A very brilliant turquoise tone shade is obtained, characterized by very good levelness.

Example 3: Wool dyeing

A wool fabric is impregnated in a padding machine at 25° C. with a bath which contains, per liter:

15 g of the dye of formula

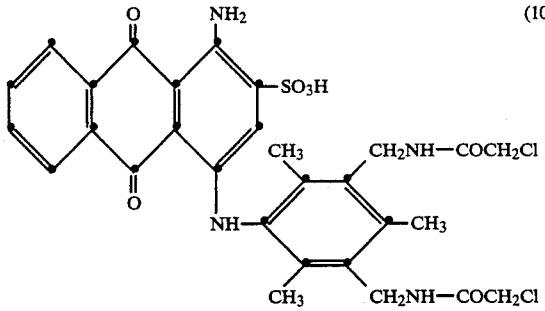

(106)

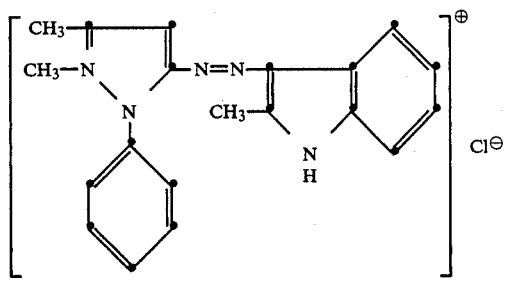

(107)

11 g of the dye of formula

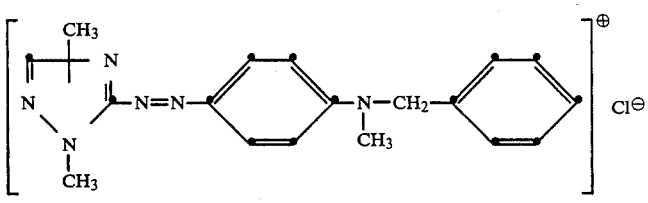

(108)

10 g of the dye of formula

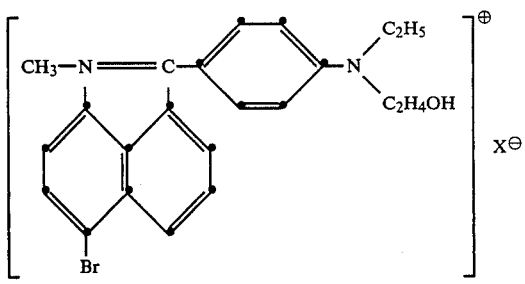

(109)

10 g of a graft polymerization product prepared according to the operating method 2
50 g of urea, and
5 g of a polyacrylic acid-based commercial thickening agent.

The pH is fixed at 6.5 by means of acetic acid.

The pick-up obtained is 110%, calculated on the weight of dry fabric (roll pressure: 1.5 bars).

The fabric is then irradiated continuously for 12 seconds with microwaves at a power of 2,500 watts (2,450 MHz frequency), and is then rinsed and dried.

An intense blue colour is obtained, characterized by its very good levelness.

Example 4: Dyeing of polyacrylic fibres

A polyacrylic fibre knit is impregnated in a padding machine at 25° C. with an aqueous solution which contains, per liter:

12 g of the dye of formula 10 g of a graft polymerization product prepared according to the operating method 2
10 g of a commercial thickening agent, and
5 g of copra fatty acids diethanolamide.

The pH is adjusted to 4.5 by means of acetic acid.

With an immersion time of 2 seconds, and a roll pressure of 1.8 bars, the pick-up is 108%.

The fabric is then subjected continuously for 14 seconds to a treatment with microwaves at a power of 2,500 watts (2,450 MHz frequency), and is then washed at 70° C. and is then rinsed cold.

A very fine brown colour is obtained, characterized by its very fine levelness and its uniform appearance.

Example 5: Cotton whitening in the bleaching bath.

A cotton fabric which has previously been subjected to an open boiling treatment is impregnated in a padding machine at 25° C. with a bath which contains, per liter:

2 g of an optical whitener of formula

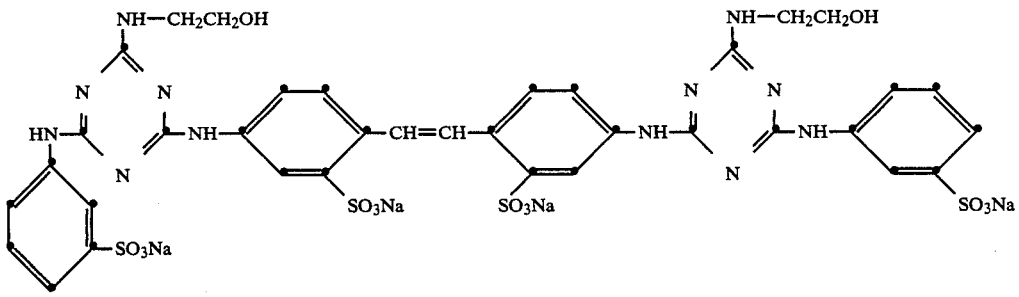

(110)

8 g of a graft polymerization product prepared according to the operating method 2
2 g of sodium silicate
8 g of caustic soda
40 g of 35% hydrogen peroxide, and
5 g of a mixture of monomeric and oligomeric methyl esters of hydroxyethane-1,1-diphosphonic acid (50% aqueous solution).

The pick-up, calculated on the weight of dry solids is 103% with a roll pressure of 1.2 bars and an impregnation time of 2 seconds.

The impregnated fabric is then irradiated continuously for 12 seconds with microwaves with a power of 2,500 watts (2,450 MHz frequency). Following this latter treatment, the fabric is rinsed at 50° C. and then at 25° C., and is then dried.

A very good optical whitening effect is obtained.

Example 6: Polyester whitening

A polyester fabric is impregnated in a padding machine at 25° C. with a bath which contains, per liter:

8 g of an optical whitener of formula

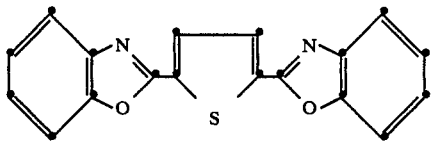

(111)

5 g of a graft polymerization product prepared according to the operating method 2
10 g of a copolymerization product consisting of acrylamide and 2-acrylamido-2-methylpropanesulfonic acid (1:1), and
5 g of the ammonium salt of the hydrogen sulfate ester of the product of addition of 2 moles of ethylene oxide to 1 mole of nonylphenol.

The pick-up calculated on the weight of dry solids is 80% with an immersion time of 1.2 seconds.

The substrate is then treated continuously for a period of 17 seconds with microwaves at a power of 2,500 watts (2,450 MHz frequency), and is then rinsed and dried.

A very fine optical whitening effect is obtained.

Example 7: Cotton bleaching

A raw tubular cotton knit with a weight of 280 g/m$^2$ is impregnated in a padding machine with an aqueous bath which contains, per liter:

8 g of a graft polymerization product prepared according to the operating method 2
5 g of a mixture of monomeric and oligomeric methyl esters of hydroxyethane-1,1-diphosphonic acid (50% aqueous solution)
2 g of sodium silicate
8 g of caustic soda, and
40 g of 35% hydrogen peroxide.

With an impregnation time of 2.5 seconds and a roll pressure of 2.0 bars, a pick-up of 130% (calculated on the weight of the dry solids) is obtained The impregnated fabric is then subjected continuously for 15 seconds to an irradiation with microwaves (frequency 2,450 MHz/power 2,500 watts).

After being rinsed at 95° and then at 25° C., the fabric is dried.

A very good bleaching effect is obtained.

Example 8: Cotton finish

A mercerized cotton popelin is impregnated at 25° C. in a padding machine with an aqueous bath which contains, per liter:

50 g of N,N'-dimethyloldihydroxyethyleneurea
2.0 g of a mixture consisting of a polyethylene wax and a fatty amine ethoxylate derivative
18 g of catalyst consisting of magnesium chloride
10 g of a graft polymerization product prepared according to the operating method 2, and
10 g of the ammonium salt of the hydrogen sulfate ester of the product of addition of 2 moles of ethylene oxide to 1 mole of nonylphenol.

With an immersion of 1.8 seconds and a roll pressure of 1.4 bars, a pick-up of 98%, calculated on the weight of dry solids, is obtained.

The substrate impregnated in this manner is then subjected continuously for a period of 25 seconds to a treatment with microwaves at a power of 2,500 watts (2,450 MHz frequency).

A very good crease-resistance effect is obtained.

What is claimed is:

1. A process for dyeing or finishing textile materials, which process comprises padding the textile materials with an aqueous dyeing or finishing liquor which additionally contains a graft polymer obtained from (a) an adduct of an alkylene oxide with an at least trihydric aliphatic alcohol of 3 to 10 carbon atoms and (b) acrylamide or methacrylamide, and subsequently fixing the dye or the finish continuously by treatment with microwaves for 5 to 30 seconds.

2. A process according to claim 1, wherein the padding liquor contains a graft polymer obtained from an adduct of 4 to 100 moles of propylene oxide with a trihydric to hexahydric alkanol of 3 to 6 carbon atoms and acrylamide or methacrylamide.

3. A process according to claim 1, wherein the graft polymer contains from 2.5 to 50% by weight of the adduct and from 50 to 97.5% by weight of grafted acrylamide or methacrylamide, based on the total graft polymer.

4. A process according to claim 3, wherein the graft polymer contains from 2.5 to 30% by weight of the adduct and from 70 to 97.5% by weight of grafted acrylamide, based on the total graft polymer.

5. A process according to claim 1, wherein the padding liquor contains a graft polymer obtained from acrylamide and from an adduct of 40 to 80 moles of propylene oxide with 1 mole of glycerol.

6. A process according to claim 5, wherein the graft polymer contains from 4 to 20% by weight of the adduct of 40 to 80 moles of propylene oxide with 1 mole of glycerol and 80 to 96% by weight of grafted acrylamide, based on the total graft polymer.

7. A process according to claim 1, wherein the padding liquor contains 5 to 40 g per liter of the graft polymer in the form of a 3 to 10% aqueous solution.

8. A process according to claim 1, wherein the fixing of the dye or of the finish with microwaves takes from 5 to 18 seconds.

9. A process according to claim 1, wherein the textile materials consisting wholly or partially of cellulose fibres are dyed with substantive or reactive dyes.

10. A process according to claim 9, wherein the padding liquor additionally contains an alkali-resistant wetting agent.

11. A process according to claim 1, wherein the textile materials consisting wholly or partially of natural or synthetic polyamide fibres are dyed with anionic dyes.

12. A process according to claim 1, wherein the textile materials consisting wholly or partially of polyesters are dyed with disperse dyes.

13. A process according to claim 1, wherein the textile materials consisting wholly or partially of polyacrylonitrile fibres are dyed with cationic dyes.

14. A process according to claim 1, wherein the textile materials consist partly of cotton and partly of polyester.

15. A process according to claim 1, wherein the liquor pick-up at the padding stage is from 60 to 200%, based on the dry weight of the substrate.

16. A bleaching process for cotton, which comprises padding the textile substrate with an aqueous liquor which contains an inorganic oxidizing agent, a graft polymer obtained from (a) an adduct of an alkylene oxide with an at least trihydric aliphatic alcohol of 3 to 10 carbon atoms and (b) acrylamide or methacrylamide, an alkali metal hydroxide, a surfactant and at least one stabilizer, and subsequently treating said substrate with microwaves continuously for 5 to 30 seconds.

* * * * *